US010605066B2

(12) United States Patent
Peter et al.

(10) Patent No.: US 10,605,066 B2
(45) Date of Patent: Mar. 31, 2020

(54) METHODS AND SYSTEMS AZIMUTHAL LOCKING FOR DRILLING OPERATIONS

(71) Applicants: Andreas Peter, Celle (DE); Oliver Hoehn, Hannover (DE)

(72) Inventors: Andreas Peter, Celle (DE); Oliver Hoehn, Hannover (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 19 days.

(21) Appl. No.: 15/841,763

(22) Filed: Dec. 14, 2017

(65) Prior Publication Data

US 2019/0186253 A1 Jun. 20, 2019

(51) Int. Cl.

| | |
|---|---|
| ***E21B 44/00*** | (2006.01) |
| ***E21B 7/04*** | (2006.01) |
| ***E21B 47/024*** | (2006.01) |
| *E21B 47/12* | (2012.01) |
| *E21B 7/06* | (2006.01) |
| *E21B 7/10* | (2006.01) |

(52) U.S. Cl.
CPC ..... *E21B 44/00* (2013.01); *E21B 7/04* (2013.01); *E21B 47/024* (2013.01); *E21B 7/068* (2013.01); *E21B 7/10* (2013.01); *E21B 47/124* (2013.01)

(58) Field of Classification Search
CPC ..... E21B 44/00; E21B 7/04; E21B 47/024
See application file for complete search history.

(56) References Cited

U.S. PATENT DOCUMENTS

| | | | | |
|---|---|---|---|---|
| 9,004,195 | B2 | 4/2015 | Regener et al. | |
| 2010/0211318 | A1 | 8/2010 | Brooks | |
| 2015/0167392 | A1* | 6/2015 | Sugiura | E21B 7/04 175/45 |
| 2015/0377004 | A1 | 12/2015 | Hornblower et al. | |
| 2016/0123134 | A1* | 5/2016 | Viens | E21B 7/04 175/45 |
| 2016/0201449 | A1 | 7/2016 | Dirksen et al. | |
| 2016/0245070 | A1 | 8/2016 | Vansteenwyk | |
| 2016/0282513 | A1 | 9/2016 | Holmes et al. | |

OTHER PUBLICATIONS

International Search Report, International Application No. PCT/US2018/062556, dated Feb. 27, 2019, Korean Intellectual Property Office; International Search Report 5 pages.
International Written Opinion, International Application No. PCT/US2018/062556, dated Feb. 27, 2019, Korean Intellectual Property Office; International Written Opinion 7 pages.

* cited by examiner

*Primary Examiner* — Kristyn A Hall
(74) *Attorney, Agent, or Firm* — Cantor Colburn LLP

(57) ABSTRACT

Methods and systems for controlling drilling operations are provided. The methods and systems include conveying a drilling tool into a bore and operating the drilling tool to drill in a direction, creating, with an azimuthal sensing device, a first signal at a first time and a second signal at a second time, wherein each of the first signal and the second signal are indicative of the direction of the drilling tool, and each of the first signal and the second signal are affected by at least one of an unknown but substantially constant offset error or an unknown but substantially constant scale factor error, comparing the first signal with the second signal, and adjusting the drilling direction based on the comparison of the first signal with the second signal.

22 Claims, 5 Drawing Sheets

METHODS AND SYSTEMS AZIMUTHAL LOCKING FOR DRILLING OPERATIONS

BACKGROUND

1. Field of the Invention

The present invention generally relates to downhole operations and locking azimuthal drilling direction during drilling operations.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., heat, a gas, or fluid) contained in a formation located below the earth's surface. Different types of tools and instruments may be disposed in the boreholes to perform various tasks and measurements.

When performing downhole operations, and particularly during drilling operation, it is important to know a direction of drilling, to ensure that a desired formation and/or deposit is reached, or to ensure other considerations associated with drilling are accounted for. That is, there is a need to be able to keep the trajectory of wellbores, drilled by e.g., rotary steerable systems, straight. Ensuring "straightness" can increase the rate of penetration, as well as improving an ability to run casing after drilling is completed. Typically, inclination, whether drilling vertically or horizontally, can be ensured using accelerometers. However, ensuring direction within a horizontal plane (parallel to the surface or inclined relative to the surface) can be more problematic and require complicated systems and/or post-change-in-direction corrections.

SUMMARY

Disclosed herein are methods and systems to control drilling operations. The methods and systems include conveying a drilling tool into a bore and operating the drilling tool to drill in a direction, creating, with an azimuthal sensing device, a first signal at a first time and a second signal at a second time, wherein each of the first signal and the second signal are indicative of the direction of the drilling tool, and each of the first signal and the second signal are affected by at least one of an unknown but substantially constant offset error or an unknown but substantially constant scale factor error, comparing the first signal with the second signal, and adjusting the drilling direction based on the comparison of the first signal with the second signal.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
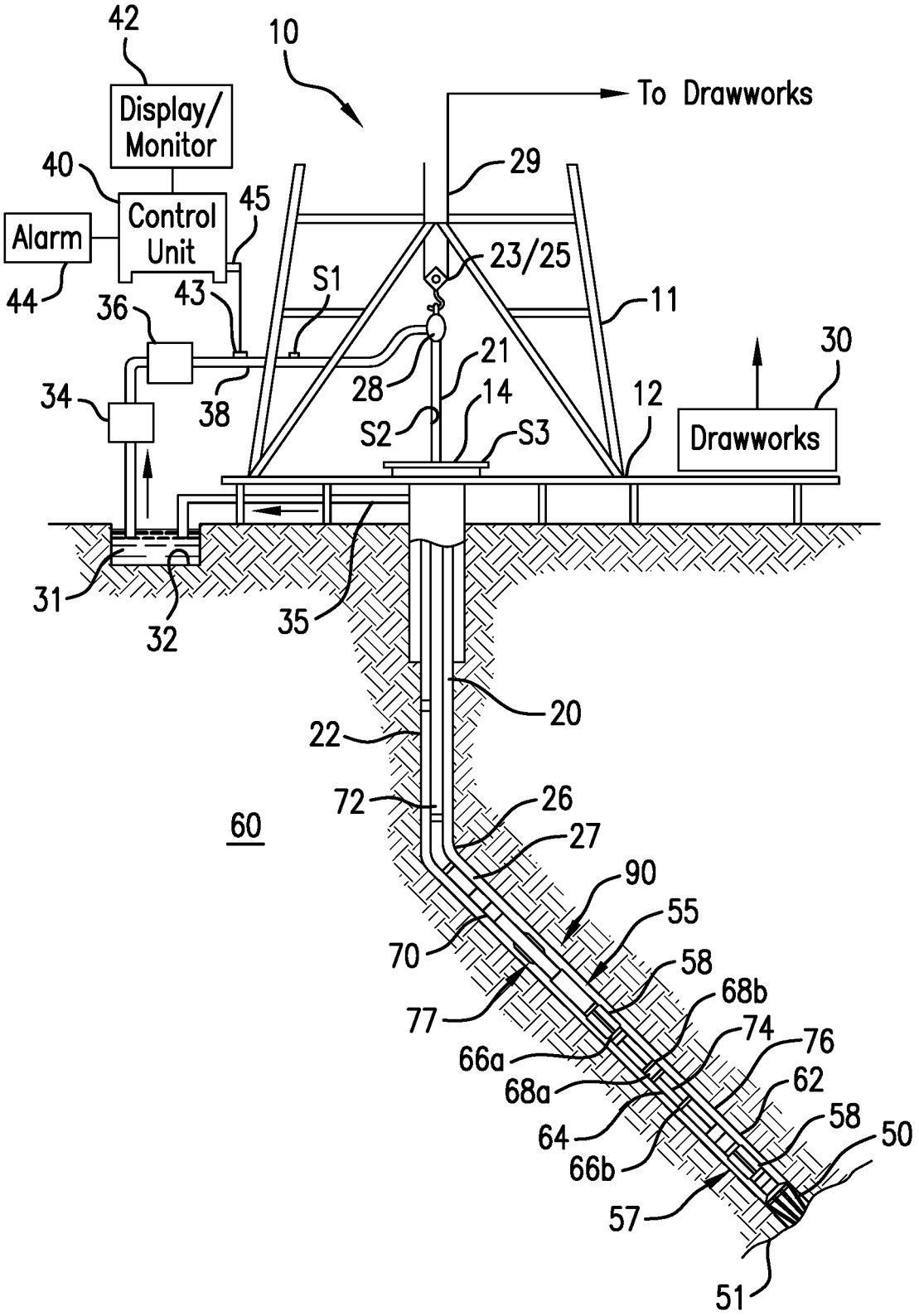
FIG. 1 is an example of a system for performing downhole operations that can employ embodiments of the present disclosure.

FIG. 1 shows a schematic diagram of a system for performing downhole operations. As shown, the system is a drilling system 10 that includes a drill string 20 having a drilling assembly 90, also referred to as a bottomhole assembly (BHA), conveyed in a wellbore or borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegrating tool 50, such as a drill bit attached to the end of the drilling assembly 90, disintegrates the geological formations when it is rotated to drill the borehole 26. The drill string 20 is coupled to a drawworks 30 via a kelly joint 21, swivel 28, traveling block 25, and line 29 through a pulley 23. During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. Fluid line 38 may also be referred to as a mud supply line. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. A sensor S1 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the borehole 26. The system may further include one or more downhole sensors 70 located on the drill string 20 and/or the drilling assembly 90.

In some applications the disintegrating tool 50 is rotated by rotating the drilling tubular 22. However, in other applications, a drilling motor 55 (such as a mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the formation 60 for a given formation and a drilling assembly largely depends upon the weight on bit and the rotational speed of the disintegrating tool 50. In one aspect of the embodiment of FIG. 1, the drilling motor 55 is coupled to the disintegrating tool 50 via a drive shaft (not shown) disposed in a bearing assembly 57. If a mud motor is employed as the drilling motor 55, the mud motor rotates the disintegrating tool 50 when the drilling fluid 31 passes through the drilling motor 55 under pressure. The bearing assembly 57 supports the radial and axial forces of the disintegrating tool 50, the downthrust of the drilling motor and the reactive upward loading from the applied weight on bit. Stabilizers 58 coupled to the bearing assembly 57 and at other suitable locations on the drill string 20 act as centralizers, for example for the lowermost portion of the drilling motor assembly and other such suitable locations.

A surface control unit 40 receives signals from the downhole sensors 70 and devices via a sensor 43 placed in the fluid line 38 as well as from sensors S1, S2, S3, hook load sensors, sensors to determine the height of the traveling block (block height sensors), and any other sensors used in the system and processes such signals according to programmed instructions provided to the surface control unit 40. For example, a surface depth tracking system may be used that utilizes the block height measurement to determine a length of the borehole (also referred to as measured depth of the borehole) or the distance along the borehole from a reference point at the surface to a predefined location on the drill string 20, such as the disintegrating tool 50 or any other suitable location on the drill string 20 (also referred to as measured depth of that location, e.g. measured depth of the disintegrating tool 50). Determination of measured depth at a specific time may be accomplished by adding the measured block height to the sum of the lengths of all equipment that is already within the wellbore at the time of the block-height measurement, such as, but not limited to drilling tubulars 22, drilling assembly 90, and disintegrating tool 50. Depth correction algorithms may be applied to the measured depth to achieve more accurate depth information. Depth correction algorithms, for example, may account for length variations due to pipe stretch or compression due to temperature, weight-on-bit, wellbore curvature and direction. By monitoring or repeatedly measuring block height, as well as lengths of equipment that is added to the drill string 20 while drilling deeper into the formation over time, pairs of time and depth information are created that allow estimation of the depth of the borehole 26 or any location on the drill string 20 at any given time during a monitoring period. Interpolation schemes may be used when depth information is required at a time between actual measurements. Such devices and techniques for monitoring depth information by a surface depth tracking system are known in the art and therefore are not described in detail herein.

The surface control unit 40 displays desired drilling parameters and other information on a display/monitor 42 for use by an operator at the rig site to control the drilling operations. The surface control unit 40 contains a computer that may comprise memory for storing data, computer programs, models and algorithms accessible to a processor in the computer, a recorder, such as tape unit, memory unit, etc. for recording data and other peripherals. The surface control unit 40 also may include simulation models for use by the computer to process data according to programmed instructions. The control unit responds to user commands entered through a suitable device, such as a keyboard. The control unit 40 can output certain information through an output device, such as s display, a printer, an acoustic output, etc., as will be appreciated by those of skill in the art. The control unit 40 is adapted to activate alarms 44 when certain unsafe or undesirable operating conditions occur.

The drilling assembly 90 may also contain other sensors and devices or tools for providing a variety of measurements relating to the formation 60 surrounding the borehole 26 and for drilling the borehole 26 along a desired path. Such devices may include a device for measuring formation properties, such as the formation resistivity or the formation gamma ray intensity around the borehole 26, near and/or in front of the disintegrating tool 50 and devices for determining the inclination, azimuth and/or position of the drill string. A logging-while-drilling (LWD) device for measuring formation properties, such as a formation resistivity tool 64 or a gamma ray device 76 for measuring the formation gamma ray intensity, made according an embodiment described herein may be coupled to the drill string 20 including the drilling assembly 90 at any suitable location. For example, coupling can be above a lower kick-off sub-assembly 62 for estimating or determining the resistivity of the formation 60 around the drill string 20 including the drilling assembly 90. Another location may be near or in front of the disintegrating tool 50, or at other suitable locations. A directional survey tool 74 that may comprise means to determine the direction of the drilling assembly 90 with respect to a reference direction (e.g., magnetic north, vertical up or down direction, etc.), such as a magnetometer, gravimeter/accelerometer, gyroscope, etc. may be suitably placed for determining the direction of the drilling assembly, such as the inclination, the azimuth, and/or the toolface of the drilling assembly. Any suitable direction survey tool may be utilized. For example, the directional survey tool 74 may utilize a gravimeter, a magnetometer, or a gyroscopic device to determine the drill string direction (e.g., inclination, azimuth, and/or toolface). Such devices are known in the art and therefore are not described in detail herein.

Direction of the drilling assembly may be monitored or repeatedly determined to allow for, in conjunction with depth measurements as described above, the determination of a wellbore trajectory in a three-dimensional space. In the above-described example configuration, the drilling motor 55 transfers power to the disintegrating tool 50 via a shaft (not shown), such as a hollow shaft, that also enables the drilling fluid 31 to pass from the drilling motor 55 to the disintegrating tool 50. In alternative embodiments, one or more of the parts described above may appear in a different order, or may be omitted from the equipment described above.

Still referring to FIG. 1, other LWD devices (generally denoted herein by numeral 77), such as devices for measuring rock properties or fluid properties, such as, but not limited to, porosity, permeability, density, salt saturation, viscosity, permittivity, sound speed, etc. may be placed at suitable locations in the drilling assembly 90 for providing information useful for evaluating the subsurface formations 60 or fluids along borehole 26. Such devices may include, but are not limited to, acoustic tools, nuclear tools, nuclear magnetic resonance tools, permittivity tools, and formation testing and sampling tools.

The above-noted devices may store data to a memory downhole and/or transmit data to a downhole telemetry system 72, which in turn transmits the received data uphole to the surface control unit 40. The downhole telemetry system 72 may also receive signals and data from the surface control unit 40 and may transmit such received signals and data to the appropriate downhole devices. In one aspect, a mud pulse telemetry system may be used to communicate data between the downhole sensors 70 and devices and the surface equipment during drilling operations. A sensor 43 placed in the fluid line 38 may detect the mud pressure variations, such as mud pulses responsive to the data transmitted by the downhole telemetry system 72. Sensor 43 may generate signals (e.g., electrical signals) in response to the mud pressure variations and may transmit such signals via a conductor 45 or wirelessly to the surface control unit 40. In other aspects, any other suitable telemetry system may be used for one-way or two-way data communication between the surface and the drilling assembly 90, including but not limited to, a wireless telemetry system, such as an acoustic telemetry system, an electro-magnetic telemetry system, a wired pipe, or any combination thereof. The data communication system may utilize repeaters in the drill string or the wellbore. One or more wired pipes may be made up by joining drill pipe sections, wherein each pipe section includes a data communication link that runs along the pipe. The data connection between the pipe sections may be made by any suitable method, including but not limited to, electrical or optical line connections, including optical, induction, capacitive or resonant coupling methods. A data communication link may also be run along a side of the drill string 20, for example, if coiled tubing is employed.

The drilling system described thus far relates to those drilling systems that utilize a drill pipe to convey the drilling assembly 90 into the borehole 26, wherein the weight on bit is controlled from the surface, typically by controlling the operation of the drawworks. However, a large number of the current drilling systems, especially for drilling highly deviated and horizontal wellbores, utilize coiled-tubing for conveying the drilling assembly downhole. In such application a thruster is sometimes deployed in the drill string to provide the desired force on the disintegrating tool 50. Also, when coiled-tubing is utilized, the tubing is not rotated by a rotary table but instead it is injected into the wellbore by a suitable injector while a downhole motor, such as drilling motor 55, rotates the disintegrating tool 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* or and receivers 68*a* or 68*b*. Resistivity can be one formation property that is of interest in making drilling decisions. Those of skill in the art will appreciate that other formation property tools can be employed with or in place of the resistivity tool 64.

Liner drilling or casing drilling can be one configuration or operation used for providing a disintegrating device that becomes more and more attractive in the oil and gas industry as it has several advantages compared to conventional drilling. One example of such configuration is shown and described in commonly owned U.S. Pat. No. 9,004,195, entitled "Apparatus and Method for Drilling a Wellbore, Setting a Liner and Cementing the Wellbore During a Single Trip," which is incorporated herein by reference in its entirety. Importantly, despite a relatively low rate of penetration, the time of getting a liner to target is reduced because the liner is run in-hole while drilling the wellbore simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Although FIG. 1 is shown and described with respect to a drilling operation, those of skill in the art will appreciate that similar configurations, albeit with different components, can be used for performing different downhole operations. For example, wireline, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired downhole operation(s).

There is a need to be able to ensure a desired trajectory of a wellbores drilled by, e.g., rotary steerable systems. Good straightness can increase the rate of penetration as well as it improve the ability to run casing after the drilling operation is complete. While inclination control is readily available, simple, and easily employed (e.g., often using a simple inclination measurement by accelerometer), azimuthal (e.g., horizontal plane) direction control of the drilling operation, and thus the drilled borehole can be more difficult. For example, because of the vicinity to a magnetic influence of a drill bit (or other parts of a bottom hole assembly) and because of a possible lack of sensors or suitable navigational grade sensors, i.e. magnetometers, it may be difficult to measure the azimuth of the borehole precisely, particularly during rotation of the drilling tool (e.g., rotary steerable system). There may also be a lack of information (e.g., magnetic dip at current location, etc.) that may prevent a direct calculation of azimuth.

Embodiments provided herein are directed to systems and methods for enabling drilling a straight borehole in an azimuthal direction without being able to exactly or precisely measure the azimuth and without the need to implement highly accurate, navigational grade magnetometers. For example, some embodiments provided herein leverage statistical smoothing of high numbers of individual measurements, identifying deviation trends, and inputting the trends into a closed loop steering control algorithm. The trends discussed and employed herein are "near bit" sensor output trends, as will be appreciated by those of skill in the art in view of the present disclosure. In some embodiments, rather than setting a specific azimuthal value as a target value, a "lock-in" direction can be set for the steering direction. The "lock-in" direction is a current drilling direction that is set at the initiation of the azimuthal locking in accordance with embodiments provided herein. That is, a currently active drilling direction can be set and subsequently maintained such that the present direction/course of drilling is maintained during operation of the present systems/methods.

As used herein, "locking" or "lock-in" (and similar terms) means that no target azimuth is downlinked or set. Rather, a command to hold a "current" attitude is sent to the tool—i.e., no specific target angle, direction, etc. is instructed to the tool. Because azimuth changes lead to changes in certain measurements (e.g. measurements in the magnetometers), maintaining a locked-in azimuth direction can be achieved. Accordingly, in accordance with embodiments of the present disclosure, when a downhole tool receives a command to lock the attitude, the system will obtain a current sensor value of a sensor which is affected by azimuthal changes (e.g. the value of a Hz magnetometer), as target value. Subsequently, a steering unit controls the steerforces in order to make the current sensor value stay on that previously locked value. As such, the azimuthal direction is held constant because the current sensor value changes correlate to azimuth changes, and thus are adjusted or corrected.

Embodiments provided herein are directed to systems and methods having a magnetometer located near the bottom end of a drilling tool (e.g., bottomhole assembly, disintegrating device, etc.). The magnetometer is oriented to be sensitive in a direction perpendicular to a longitudinal tool axis of the drilling tool. In some embodiments, a gravity toolface sensor, e.g., an accelerometer, can be employed with processes described herein. Hereinafter, azimuthal sensing device can refer to magnetometers, accelerometers, gyroscopes, and/or other sensing elements/devices as known in the art, and are employed with embodiments described herein (among having potentially other functions). In operation, the azimuthal sensing device is sampled to receive data therefrom, with the sampling obtaining on a continuous and real-time basis. Due to drilling tool rotation, the sampled data of the signals from the azimuthal sensing device resembles a sinusoidal shape. The sinusoidal shape will be blurred and distorted due to a number of influence factors, including, but not limited to, tool vibration, stick slip, rpm, and fluctuating magnetic influence on the azimuthal sensing device from electrical current passing the azimuthal sensing device inside the drilling tool. Those of skill in the art will appreciate that the above discussion applies when the inputs are Hx, Hy as inputs, as described below. Other schemes are possible without departing from the scope of the present disclosure. For example, if azimuth-lock is based on Hz tool rotation may not impact the operation.

However, even with such influences, the point in time when the sinusoidal shape of a data stream or signal from an azimuthal sensing device reaches a maximum can be determined by a maximum value searching algorithm, as provided in accordance with embodiments disclosed herein. High sampling rates can improve the effectiveness of a search algorithm. For each revolution of the drilling tool, the difference in time between reaching the maximum value of a signal received from an azimuthal sensing device (e.g., a magnetometer signal) is stored into memory. Furthermore, in some embodiments, a peak-to-peak amplitude of the signal received from the azimuthal sensing device is also stored into memory. In some embodiments, direct Hz measurements can be employed, instead of peak-to-peak values. In other embodiments, offset between gravity tool face and magnetic tool face can be employed.

Figure 2:
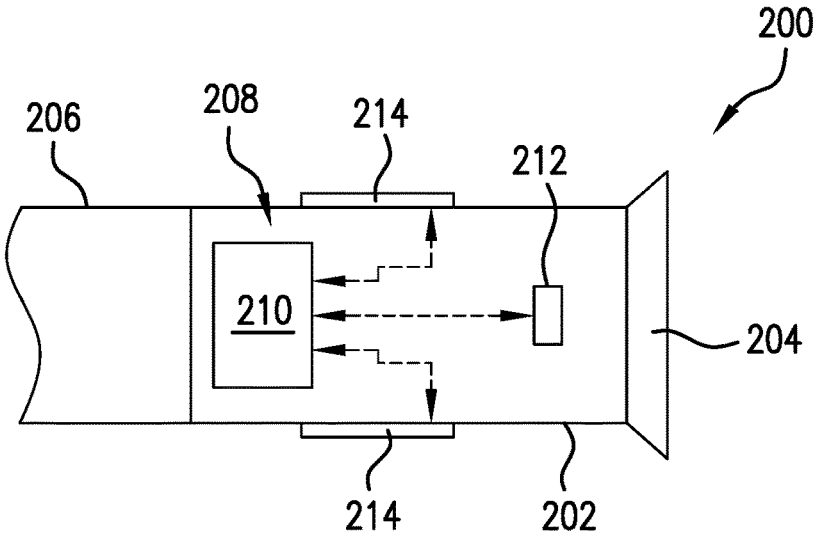
FIG. 2 is a schematic illustration of an azimuthal locking system in accordance with an embodiment of the present disclosure.

Turning now to FIG. 2, a schematic illustration of a downhole system 200 that can employ embodiments of the present disclosure is shown. The downhole system 200, as shown, is a drilling system having a bottomhole assembly 202 with a disintegrating device 204 located on an end thereof. The bottomhole assembly 202 is operably connected to a drill string 206, with rotation of the disintegrating device 204 achieved, at least in part, through rotation of the drill string 206. The bottomhole assembly 202 can include various components as known in the art, including inclination control and/or other steering components/elements. The downhole system 200 is arranged to drill a borehole into and/or through a formation, as will be appreciated by those of skill in the art.

The downhole system 200 further includes an azimuthal locking system 208. The azimuthal locking system 208 includes a controller 210, one or more azimuthal sensing devices 212 operably connected to and/or in communication with the controller 210, and one or more drilling direction adjustment elements 214 operably connected to and/or in communication with the controller 210. The controller 210 can be a dedicated computing system or may be part of an electronic control system of the bottomhole assembly 202 (as shown) or may be arranged in other locations within the downhole system 200. The controller 210 can provide processing and/or other computational aspects of embodiments of the present disclosure, as described herein and/or as appreciated by those of skill in the art. The controller 210 is in communication with the azimuthal sensing device 212 to receive a signal and/or data therefrom. In some embodiments, the controller 210 can include a preprocessing operation (e.g., a sliding-average filter to apply to a signal received from the azimuthal sensing device 212). Although described herein, in a non-limiting embodiment, as a sliding average filter, other filters (e.g., block average filter, peak-to-peak filter, etc.), observers (e.g., Kalman filter), or other types of preprocessing can be employed without departing from the scope of the present disclosure. For example, without limitations, preprocessing can include infinite impulse filters, finite impulse response filters, and/or other digital filters or other types of filters as will be appreciated by those of skill in the art. Further, in some embodiments, the received signal from the azimuthal sensing device 212 can include unknown errors, and yet the processes described herein are still applicable and functions. For example, in some embodiments, the azimuthal sensing device 212 signal can include unknown but substantially constant offset and/or scale factor errors.

The azimuthal sensing device 212 is, at a minimum, a magnetometer, although other sensing elements or devices can be included therein. For example, in some embodiments, the azimuthal sensing device 212 can include multiple magnetometers. Further, in some embodiments, the azimuthal sensing device 212 can include an accelerometer. Additional sensing and/or detection elements, devices, or components can be included with the azimuthal sensing device 212 and/or may be associated therewith. The azimuthal sensing device 212 is arranged to detect a magnetic direction (e.g., compass direction) based on the earth's magnetic field, and thus detect an azimuthal direction. As noted, in some embodiments, the azimuthal sensing device 212 signal output can include unknown but substantially constant offset and/or scale factor errors.

In operation, the controller 210 can actively and continuously receive and monitor a signal from the azimuthal sensing device 212. The monitored signal, in some non-limiting embodiments, may be a magnetic signal or a signal that is derived from magnetic measurements. For example, a Hz sensor signal is proportional to azimuth and can be measured and monitored directly. Changes in Hx and Hy values are correlated to azimuth changes, but are also affected by tool rotation. Therefore, the amplitude of Hx or Hy is determined and can then be used as control variable. Another derived value, for example, can be a toolface offset which is correlated to azimuthal changes. The toolface offset is calculated based on magnetometer and accelerometer measurements.

Using the below described processes, the controller 210 can activate an azimuthal lock operation, wherein the controller 210 will operate to ensure a straight (or relatively straight) drilling direction based on the activation of the azimuthal lock operation. The activation of the azimuthal lock operation can be received from a surface controller, internal programming within the controller 210, and/or from other sources, as will be appreciated by those of skill in the art. For example, in one non-limiting embodiment, the controller 210 can be in communication with a surface controller operated by an operator. The operator may monitor a direction of drilling, and when a desired direction of drilling is observed, the operator can send an instruction downhole to the controller 210 to activate the azimuthal lock operation. The activation of the azimuthal lock operation sets a current direction to be maintained, hereinafter "locked azimuth drilling direction."

Once activated, the controller 210 can actively monitor the signal from the azimuthal sensing device 212. By monitoring, for example, peak-to-peak signal information, the controller 210 can detect deviations from the locked azimuth drilling direction. As long as general external influence factors (e.g., inclination, bit magnetization, a resulting magnetic field of electrical current passing the sensor inside the tool, etc.) remain constant, any deviation from the locked-in signal value is indicative of a deviation of the azimuthal drilling direction. If a deviation occurs, based on a deviation in signal which occurs due to a deviation in azimuth drilling direction, the controller 210 can control the drilling direction adjustment elements 214 to enable a drilling direction adjustment operation or action to be performed, to thus enable adjustment (e.g., correction) of a drilling direction. The drilling direction adjustment elements 214 can be blades, fins, extending elements, ribs, pads, or other elements, components, or structures, that can be controlled to apply a force to a borehole wall, or point a disintegrating tool into a desired direction, and thus adjust a direction of drilling, as will be appreciated by those of skill in the art. As the drilling direction adjustment elements 214 apply a force to adjust the direction of drilling, the controller 210 continuous to monitor the signal from the azimuthal sensing device 212, and can deactivate or retract the drilling direction adjustment elements 214 such that overcompensation of direction is not achieved.

As noted, the controller 210 will monitor a signal received from the azimuthal sensing device 212. The controller 210 may monitor, in some embodiments, a time difference and/or peak-to-peak amplitudes of the signal. Due to the above-mentioned influence factors, a time difference and/or the peak-to-peak amplitude will vary between consecutive revolutions of the downhole system 200. In one non-limited example, a drilling tool rotational speed of 120 rpm to 360 rpm, the controller 210 can record data points associated with the signal received from the azimuthal sensing device 212. In this example, the controller 210 may store data points at a rate of about 2 Hz to 6 Hz. The controller 210 will then perform a preprocessing operation (e.g., sliding average filter) across the data stream to smoothen out all short cycle influence factors. Because the drilling direction will not change abruptly, the preprocessing can be set to be averaging across fairly long intervals, e.g., up to one minute. In another embodiment, signal characteristics such as peak-to-peak values, mean values, etc. are determined using a recursive algorithm with the need to record data points.

Figure 3:
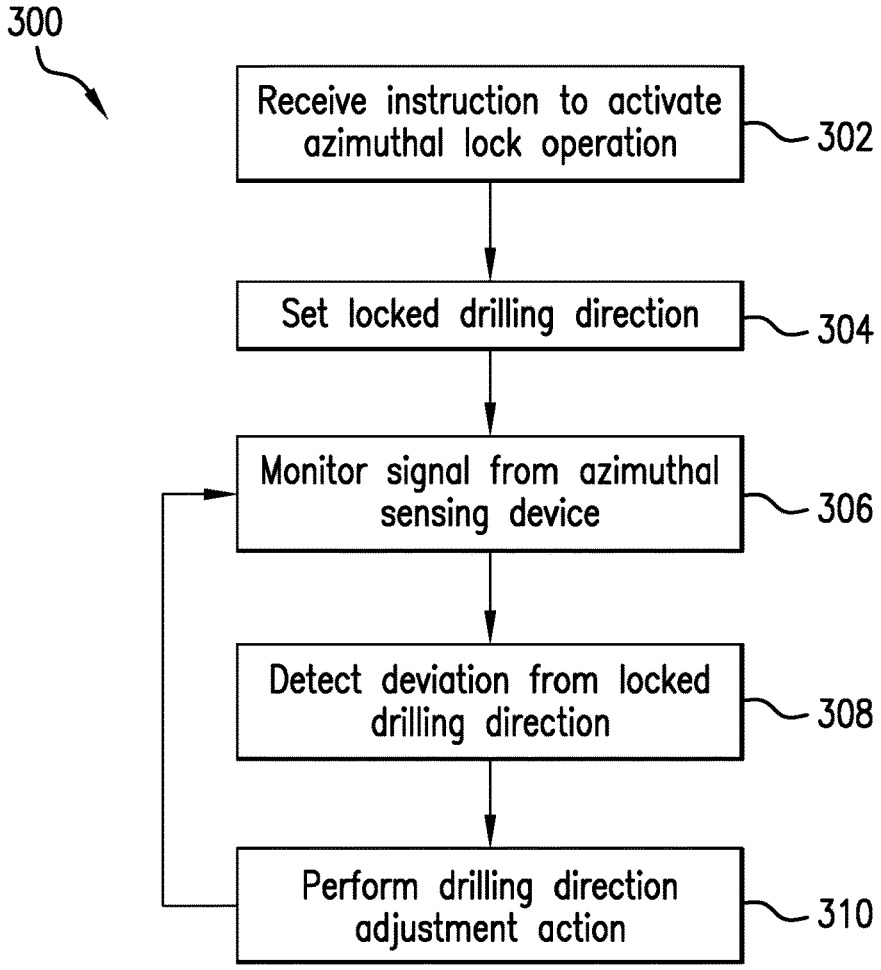
FIG. 3 is a flow process for performing an azimuthal lock operation in accordance with an embodiment of the present disclosure.

Turning now to FIG. 3, a flow process 300 for performing an azimuthal lock operation in accordance with an embodiment of the present disclosure is shown. The flow process 300 can be performed by systems as shown and described above or on other downhole systems without departing from the scope of the present disclosure. The flow process 300 is performed using a controller, at least one azimuthal sensing device in communication therewith, and at least one drilling direction adjustment element, such as shown and described above. The controller can be arranged to continuously receive a signal from the azimuthal sensing device and record the signal on memory thereof. In some embodiments, the recorded information may be time and amplitude information of the signal received. In another embodiment, only characteristic values of a signal (e.g., peak-to-peak values, mean values, etc.) are recorded on the memory.

Prior to activation of the flow process 300, an operator or other system may optionally determine a direction (e.g., compass direction) in which a drilling operation is currently drilling. The flow process 300 may subsequently be based on the determined direction. The initial direction information (e.g., which quadrant of a compass) associated with a drilling operation can be downlinked from the surface, transmitted from a survey-capable tool inside the downhole system, and/or obtained from a survey-capable tool of the bottomhole assembly.

At block 302, the controller receives instructions to activate an azimuthal lock operation. The azimuthal lock operation is performed to ensure a substantially straight drilling direction by automatically adjusting and/or correcting for deviations in azimuth direction in real-time. The instruction can be transmitted from the surface from a control system operated by an operator located at the surface and/or from a surface computer or control system that monitors the drilling direction of the system. In some embodiments, the activation can be based on self-monitoring provided within the controller or other downhole control system. For example, a drilling plan can be stored within the controller and upon achieving a given criteria (e.g., a predetermined depth, or other criteria), the azimuthal lock operation can be activated.

At block 304, when the azimuthal lock operation is activated, a locked azimuth drilling direction or locked attitude is set. The locked azimuth drilling direction is a drilling direction that exists at the time the azimuthal lock operation is activated or a direction of drilling that is desired to be maintained. In some embodiments, the locked azimuth drilling direction can be set based on a delay in time from when the activation of the azimuthal lock operation is activated (e.g., activation occurs, and a preset delay passes prior to setting of the locked azimuth drilling direction).

The setting of the locked azimuth drilling direction, in accordance with embodiments herein, is based on recording an azimuthal signal property of a signal received from the azimuthal sensing device (e.g., a locked-in azimuthal signal). In one non-limiting embodiment, the azimuthal signal property can be a peak-to-peak amplitude of a signal received from the azimuthal sensing device. Because the controller continuously monitors (and records) the signal and the azimuthal signal property, when the activation is instructed, the controller includes a historical set of data to determine a current azimuthal signal property that is used to set or lock in the current direction of drilling (locked azimuth drilling direction). The controller is then able to monitor and compare a current signal with the signal (also referred to herein as a "first signal" or "locked-in signal") of the locked azimuth drilling direction to determine if the same direction is being maintained or if a deviation is occurring.

At block 306, the controller actively and continuously monitors the signal from the azimuthal sensing device (an "active signal" also referred to herein as a "second signal"). In some embodiments, the first and second signals are derived from a preprocessing of the signal (e.g., application of a filter). The monitoring is a calculation and comparison of the first and the second signals. For example, in some such embodiments, the locked azimuth drilling direction is a set sliding average, and the controller will compare a current sliding average against the locked azimuth drilling direction sliding average. During the monitoring, the controller is configured to take no action if the current signal ("second signal") matches the locked azimuth drilling direction signal ("first signal"). The match may be within some predefined range of values, such as 1-2% variance. If the monitored current signal deviates from the locked azimuth drilling direction signal by more than the predefined range, e.g., exceeds 2% difference, then the controller will detect that an azimuthal deviation has occurred. Although example values of acceptable variance are provided herein, those of skill in the art will appreciate that his is merely for example and other variances are possible without departing from the scope of the present disclosure.

At block 308, the controller detects the deviation from the locked azimuth drilling direction. The detection of the deviation is a result of a drilling operation that turns or deviates from the locked azimuth drilling direction. This means that the drilling direction is no longer in the preset or desired drilling direction. In some embodiments, the deviation is detected based on a difference between the mean values of the locked azimuth drilling direction signal and the active signal.

At block 310, when a deviation from the locked azimuth drilling direction is detected, the controller performs a drilling direction adjustment action. The drilling direction adjustment action can include, but is not limited to, extending pads or blades from a downhole component that are proximate a disintegrating device. The extended pads/blades can apply force to a borehole wall to thus force the disintegrating device to alter course in a direction that adjusts and/or corrects for the detected deviation. The drilling direction adjustment action may alternatively include changing the direction the disintegrating device is pointing into, using suitable actuation devices of, e.g., a point the bit rotary steerable system.

In one non-limiting example, the drilling direction adjustment action can be a continuous, monitored process. For example, the action can include operating a drilling direction adjustment element to steer in one direction for a limited amount of time. As the steering operation is performed over the limited amount of time, the active signal is monitored. As a change in the active signal occurs, the direction of the adjustment action can be updated based on the observed change. As such, an updated drilling adjustment direction can be set and changes in the active signal can be monitored.

The flow process will continuously monitor the signal from the azimuthal sensing device to ensure that the desired direction of drilling (locked azimuth drilling direction) is maintained. Further, as described below, directional adjustment correction can be relative to the cardinal directions, and thus deviation to the "left" or the "right" can be detected and appropriate adjustment and correction to maintain a desired drilling direction can be accomplished.

Figure 4A:
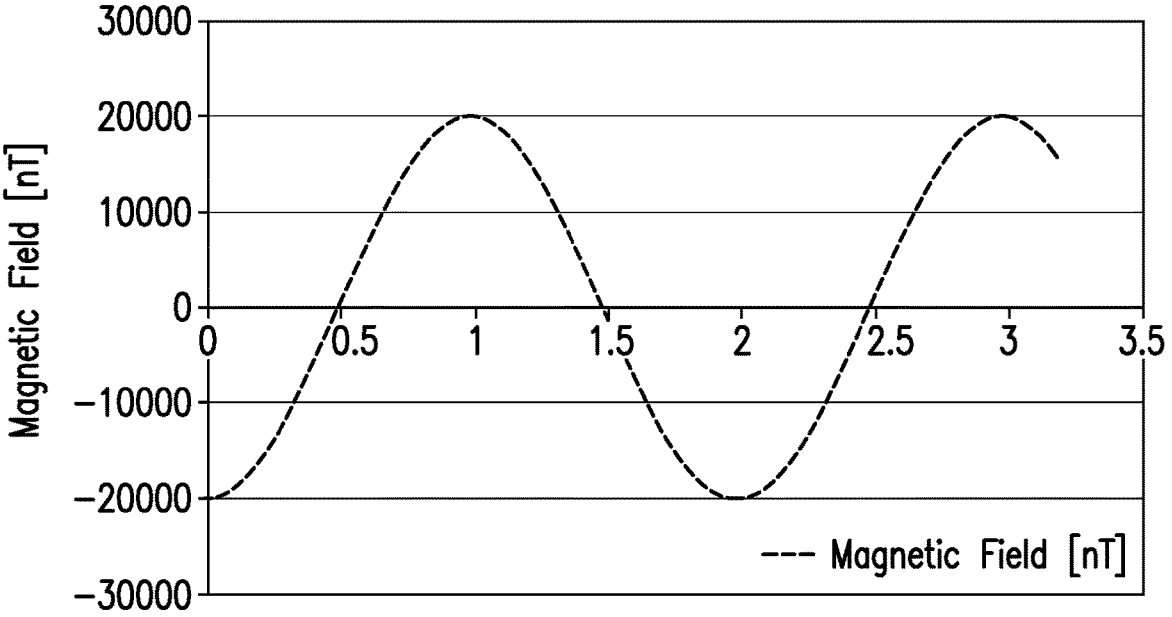
FIG. 4A is an idealistic shape of a signal from an azimuthal sensing device in accordance with an embodiment of the present disclosure.
Figure 4B:
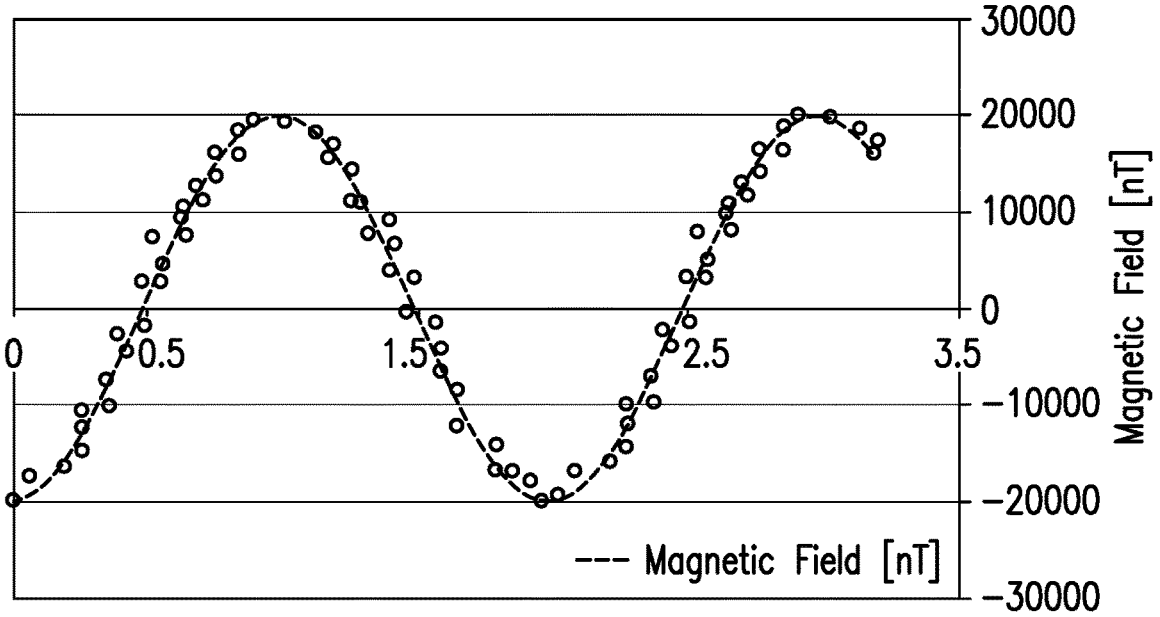
FIG. 4B is a plot showing a set of data points obtained from an azimuthal sensing device in accordance with an embodiment of the present disclosure during a period of operation during a drilling operation as compared to the idealistic shape of FIG. 4A.
Figure 4C:
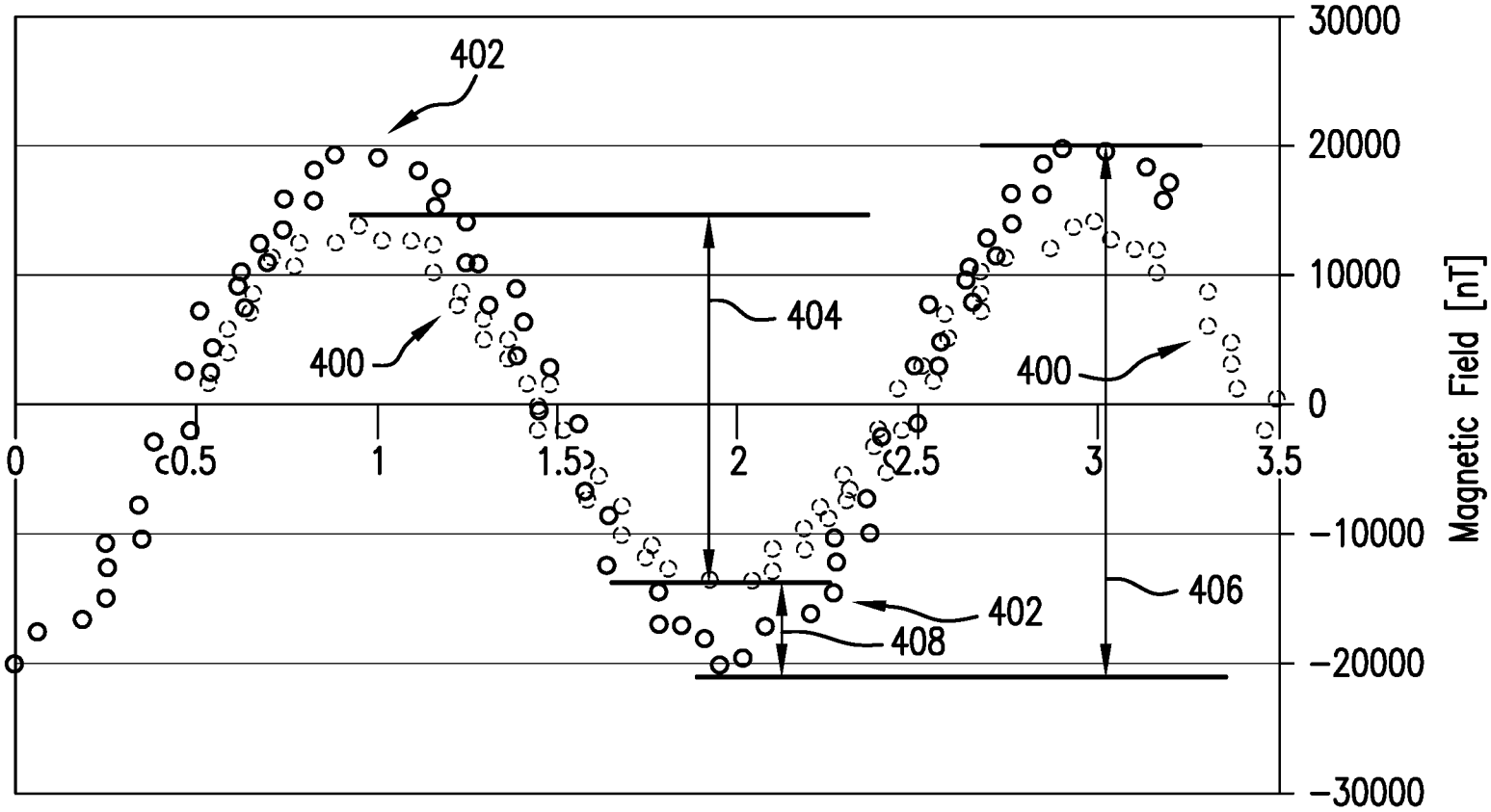
FIG. 4C is a plot illustrating a comparison of a current azimuthal sensing device signal as compared to the locked-in drilling direction set of data points of FIG. 4B, in accordance with an embodiment of the present disclosure.

Turning now to FIGS. 4A-4C, schematic plots illustrating aspects of the present disclosure are show. FIG. 4A is an idealistic shape of a signal from an azimuthal sensing device. FIG. 4B is a plot showing a set of data points obtained from an azimuthal sensing device during a period of operation during a drilling operation as compared to the idealistic shape of FIG. 4A, the data points representing a locked-in or target drilling direction signal. FIG. 4C is a plot illustrating a comparison of a current azimuthal sensing device drilling direction signal as compared to the locked-in drilling direction set of data points of FIG. 4B. The plots of FIGS. 4A-4C are employed for an embodiment of an azimuthal locking system having a single magnetometer configured as the azimuthal sensing device. Accordingly, a single set of magnetometer data is collected and passed through a preprocessing operation (e.g., sliding-average filter, etc.) at a controller.

As noted, FIG. 4A illustrates an idealized signal that would be received at a controller receiving a signal or data from an azimuthal sensing device during a drilling operation. As shown, the signal is a sinusoidal shape, which is a result of the rotation of the drilling system. FIG. 4B shows an overlay of data points collected at the controller during a sample drilling operation. As is apparent, the data points substantially align with the idealized signal. In this example, and operator may wish to lock-in the current attitude that is represented by the signal/data points shown in FIG. 4B. Thus, the process described above can be implemented, wherein an instruction to lock in the current attitude is provided to activate an azimuthal lock operation is performed.

FIG. 4C represents a plot of current collected data points 400 (e.g., an "active signal") as compared to locked-in data points 402. The controller monitors the current collected data points 400 and compares such data against the locked-in data points 402. In this embodiment, peak-to-peak amplitudes are monitored to determine if a deviation of a drilling azimuth is detected. For example, as shown, the current collected data points 400 have a current peak-to-peak amplitude 404 and the locked-in data points 402 have a locked-in peak-to-peak amplitude 406. In this illustration, the current peak-to-peak amplitude 404 is less than the locked-in peak-to-peak amplitude 406. The difference in peak-to-peak amplitudes indicates a deviation in the signal which is indicative of a deviation in azimuth from the initial, locked-in azimuth drilling direction. As shown, an amplitude difference 408 exists between the two sets of data points. The amplitude difference 408 can be used to determine if a sufficient deviation has occurred that requires azimuth drilling direction adjustment action to be taken. For example, if the amplitude difference 408 (which can be expressed as a percent difference) exceeds a predetermined threshold, then azimuth drilling direction adjustment action can be taken. The current collected data can be continuously monitored, during and after an azimuth drilling direction adjustment action is taken to ensure that the azimuth drilling direction adjustment is sufficient and to ensure that additional deviations do not occur and/or are adjusted or corrected.

A non-limiting example of an azimuth drilling direction adjustment operation in accordance with an embodiment of the present disclosure will now be described. During normal drilling operations, an azimuthal locking system will continuously monitor and record a signal from an azimuthal sensing device. In this example, the azimuthal sensing device includes a magnetometer and an accelerometer. A driller or operator can monitor the drilling progress and at any given time instruct the system to drill in a straight azimuthal line (e.g., within a plane). In some embodiments, the direction can be in a plane parallel with the surface, however, embodiments provided herein enable controlling an azimuth drilling direction in set inclinations (i.e., ensure no deviation in a constant or fixed inclination of drilling).

In this example, when a driller or other operator determines that a drilling operation should remain in a constant/fixed direction, the driller can send a locking-downlink to a downhole system similar to that shown described above, having an azimuthal locking system. The locking-downlink can include instructions to activate an azimuthal lock operation of the azimuthal locking system. As such, the locking-downlink can instruct a controller to lock-in a current peak-to-peak azimuthal sensing device amplitude value. In this example, the azimuthal sensing device is a magnetometer, and thus the signal is a peak-to-peak magnetometer amplitude.

The azimuthal lock operation will set a preprocessing value (e.g., sliding average value) as the lock-in or target value. The controller will then start comparing an active or live output of a processing operation (e.g., sliding average filter) applied to the signal from the azimuthal sensing device. Deviations from the locked-in value (locked azimuth drilling direction values) is indicative of a deviation of the azimuthal drilling direction. When deviations are detected, an azimuth drilling direction adjustment action is performed.

For example, when a deviation in preprocessing values exceeds a defined threshold value, the controller will control one or more drilling direction adjustment elements to apply a steer force in a direction opposite the direction of deviation. In accordance with some embodiments, the control law/logic can consider system dynamics, sensor offsets (e.g., distance between drill bit and sensor), actuator dynamics, sensor dynamics, etc. to calculate appropriate control actions. The controller can furthermore consider constraints or a cost function to calculate control actions. The controller can further consider rate of penetration and/or the duration of a deviation. What the opposite direction is depends upon the direction the borehole is being drilled during the azimuthal lock operation. Left and right deviations are discussed herein, where "left" and "right" are direction relative to a locked-in drilling direction within a plane of drilling. For example, if the borehole is pointing into a direction between North and East (0°-90°), an increase of a magnetometer peak-to-peak value indicates a deviation to the right, and a decrease indicates a deviation to the left. If the borehole is pointing into a direction between East and South (90°-180°), an increase of the magnetometer peak-to-peak value indicates a deviation to the left, and a decrease indicates a deviation to the right. If the borehole is pointing into a direction between South and West (180°-270°), an increase of the magnetometer peak-to-peak value indicates a deviation to the right, and a decrease indicates a deviation to the left. If the borehole is pointing into a direction between West and North (270°-360°), an increase of the magnetometer peak-to-peak value indicates a deviation to the left, and a decrease indicates a deviation to the right.

The above description relies, in part, upon knowing which quadrant or quarter of the compass, or hemisphere, a current drilling operation is taking place. The information about which quarter the borehole is pointing into is either sent to the downhole system and the azimuthal locking system from the surface, via downlink, or is transmitted from a survey-capable tool inside the downhole system and/or bottomhole assembly.

In some embodiments, the determination of an "opposite" direction may be determined automatically by the controller. For example, the controller may steer to one direction, e.g., to the right, for a limited amount of time and monitor the change of the active signal. If the active signal value increases, then the controller will later-on react to an increase of the active signal value, compared to the locked-in value, by steering to the left. This automatic determination may be performed by the controller in response to the activation of the azimuthal lock operation as described above.

In some embodiments, the amount of the applied steer force used during a drilling direction adjustment action may be fixed, or selectable through downlink, or variable by an additional algorithm. The additional algorithm may for instance take into consideration the inclination of the borehole.

Figure 5:
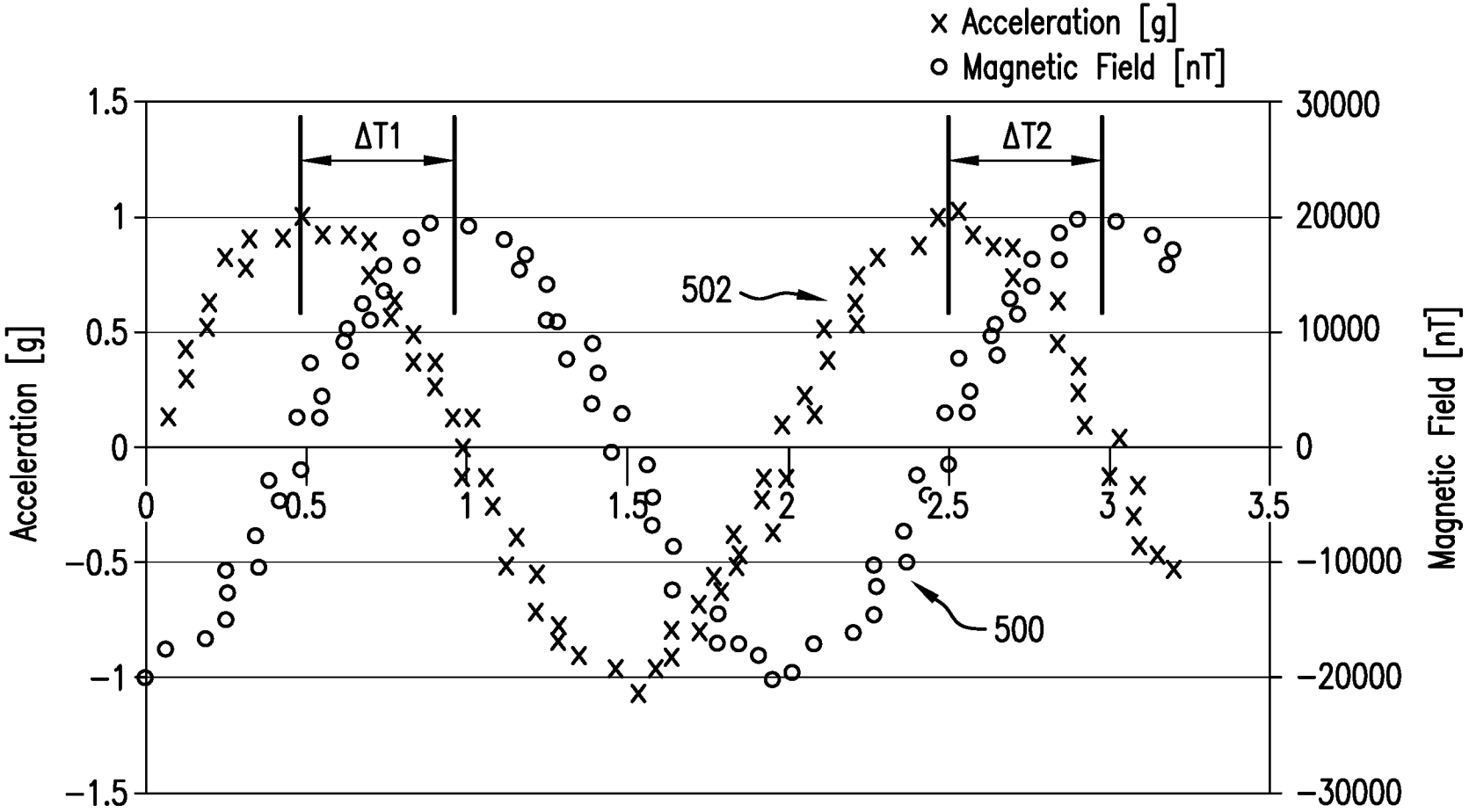
FIG. 5 is a schematic plot of a set of magnetic field data obtained from a magnetometer and a set of acceleration data obtained from an accelerometer in accordance with an embodiment of the present disclosure.

In some embodiments, the azimuthal locking system can distinguish between drilling in an eastern direction (0°-180°) and drilling in a western direction (180°-360°) by evaluation of time differences between the maximum value of the gravity toolface and the maximum value of the magnetometer signal. Accordingly, in such azimuthal locking systems an azimuthal sensing device is configured with a magnetometer and an accelerometer. For example, turning to FIG. 5, a schematic plot of a set of magnetic field data 500 obtained from the magnetometer and a set of acceleration data 502 obtained from the accelerometer are shown. By comparing the delta time $\Delta T1$, $\Delta T2$ between peaks of the magnetic field data 500 and the acceleration data 502, a general east-west direction can be determined. The correlation between $\Delta T1$, $\Delta T2$ and the east-west direction is different for drilling locations located in the southern hemisphere as compared to locations in the northern hemisphere. The following correlation is an example for a drilling location in the northern hemisphere. When the delta time $\Delta T1$, $\Delta T2$ is positive (i.e., a peak of the magnetic field data 500 occurs before a peak of acceleration data 502), the drilling is in an eastern direction, and when the delta time $\Delta T1$, $\Delta T2$ is negative (i.e., a peak of acceleration data 502 occurs before a peak of the magnetic field data 500), the drilling is in a western direction.

That is, when drilling in an eastern direction, the maximum value of the magnetometer signal will be measured during the half-revolution before reaching gravity high side. When drilling in a western direction, the maximum value of the magnetometer signal will be measured during the half-revolution after reaching gravity high side.

In accordance with some embodiments, if the drilling rpm can be held constant enough over a filtering interval, the value of the time difference between peaks amplitudes of different signals of the azimuthal sensing device may also be used as the lock-in value, and used in the closed loop steering control algorithm in a similar fashion as described for the magnetometer peak-to-peak value before. That is, rather than setting a locked-in amplitude, when an azimuthal locking system includes both a magnetometer and an accelerometer, the lock-in data can be a delta-time between peaks of two separate signals, and deviations in the delta-time can indicate a deviation in drilling direction and thus drilling direction adjustment is required.

Advantageously, embodiments provided herein enable locking in azimuthal drilling direction that can adjust for deviations in real-time. Typically, such azimuthal adjustment occurs a time after a deviation occurs due to sensitivity of sensors and thus the location thereof (typically fairly distant from the disintegrating device). This is because of interference that is generated close to a disintegrating device, including, but not limited to, a bit which may be magnetic, other electronics located near-bit, and/or eddy currents generated due to rotation of the drill string and disintegrating device.

However, embodiments provided here operate indirectly to ensure and maintain a set direction of drilling within a plane (e.g., straight line drilling). One or more azimuthal sensors (e.g., magnetometers, accelerometers, etc.) can be used to generate a magnetic field signal which can be passed through a sliding average filter, which is used to eliminate the above described influences. The sliding average filter is used to remove or eliminate the instantaneous events, and allow for the collection and aggregation of large amounts of data over time (e.g., smoothing the data). The specific or actual direction of drilling is not of concern with some embodiments of the present disclosure, rather, once a drilling direction is set, the azimuthal locking system operates to maintain a locked-in direction or drilling direction. By continuously comparing a current, real-time azimuthal signal against a locked-in signal, deviations in drilling direction can be promptly detected and adjusted or corrected.

Embodiments provided herein can provide various types of drilling direction adjustment action. For example, in a simple arrangement, when a deviation is detected, a drilling direction adjustment element can be activated to counter the deviation and adjust or correct the drilling direction of the drilling system. In some embodiments, the correction can be progressive, such that a small amount of adjustment is applied first, and the system continuously monitors the deviation to ensure that the correct drilling direction is maintained, and if the adjustment does not fix the direction, a greater amount of adjustment (e.g., a greater extension of an extending drilling direction adjustment element) can be applied. Further, variable drilling direction adjustment can be employed wherein, a first drilling direction adjustment action force is applied, and if such action does not correct the drilling direction, a second drilling direction adjustment action force can be applied (either greater or less than the first drilling direction adjustment action force). Moreover, in embodiments having knowledge of inclination (e.g., inclusion of an accelerometer), based on the inclination, different amounts of force for drilling direction adjustment can be applied. For example, in one non-limiting embodiment, if a horizontal borehole is being drilled 100% of the potential drilling direction adjustment force can be applied, but if a borehole is being drilled at non-horizontal, then less than 100% of the potential drilling direction adjustment force can be applied.

As discussed above, embodiments provided herein are used for maintaining an azimuthal direction of drilling. Such direction can be in a horizontal plane (e.g., parallel with the earth's surface) or may be an inclined (but constant) plane. Accordingly, embodiments provided herein can be used to enable drilling of straight boreholes with respect to azimuth or compass direction. Advantageously, embodiments provided herein are tolerant of deviations within the sensors themselves, and no calibration is required. That is, a value is obtained and set, and further data is compared against the initial value—and thus the "absolute" value or other information is not required to enable azimuthal drilling direction adjustment as provided herein.

Embodiment 1

A method for controlling a drilling operation, the method comprising: conveying a drilling tool into a bore and operating the drilling tool to drill in a direction; creating, with an azimuthal sensing device, a first signal at a first time and a second signal at a second time, wherein each of the first signal and the second signal are indicative of the direction of the drilling tool, and each of the first signal and the second signal are affected by at least one of an unknown but substantially constant offset error or an unknown but substantially constant scale factor error; comparing the first signal with the second signal; and adjusting the drilling direction based on the comparison of the first signal with the second signal.

Embodiment 2

A method in accordance with any embodiment herein, further comprising holding an inclination of the drilling direction substantially constant.

Embodiment 3

A method in accordance with any embodiment herein, further comprising preprocessing data obtained from the azimuthal sensing device prior to generating the first signal.

Embodiment 4

A method in accordance with any embodiment herein, wherein the preprocessing comprises applying at least one of a filter, a sliding average filter, an infinite impulse filter, a finite impulse response filter, and an observer.

Embodiment 5

A method in accordance with any embodiment herein, further comprising continuously obtaining and storing information from the azimuthal sensing device.

Embodiment 6

A method in accordance with any embodiment herein, wherein the adjustment to the drilling direction comprises at least one of applying a force using a drilling direction adjustment element against a borehole wall and changing a direction a disintegrating device is pointing.

Embodiment 7

A method in accordance with any embodiment herein, wherein comparing the first signal with the second signal includes detecting a deviation based on at least one of (i) a difference between a peak-to-peak amplitude of the first signal and the second signal, (ii) when the second signal has at least one of a percent difference and an absolute difference from the first signal that exceeds a predetermined threshold percent difference or threshold absolute difference, and (iii) a difference between a mean value of the first signal and the second signal.

Embodiment 8

A method in accordance with any embodiment herein, wherein the azimuthal sensing device comprises a magnetometer generating a magnetic field signal and an accelerometer generating an acceleration signal, wherein the adjustment to the drilling direction is based on a delta time between the magnetic field signal and the acceleration signal.

Embodiment 9

A method in accordance with any embodiment herein, further comprising determining the direction of drilling relative to a compass direction, wherein the adjustment of the drilling direction is based on the determined direction.

Embodiment 10

A method in accordance with any embodiment herein, wherein the direction of drilling relative to the compass direction is at least one of downlinked from the surface or transmitted from a survey-capable tool inside at least one of a downhole system and a bottomhole assembly.

Embodiment 11

A method in accordance with any embodiment herein, wherein a direction of adjustment of the drilling direction is determined automatically by analyzing a response of the second signal to a steering input.

Embodiment 12

A method in accordance with any embodiment herein, wherein the adjustment of the drilling direction comprises: steering in a first direction for a limited amount of time using a drilling direction adjustment element; monitoring a change of the second signal; and adjusting the first direction in relation to the observed change using the drilling direction adjustment element.

Embodiment 13

A system for controlling a drilling operation, the system comprising: a drilling tool arranged to perform the drilling operation, the drilling operation having a direction; a controller configured to receive an instruction to activate an azimuthal lock operation; an azimuthal sensing device in communication with the controller, the azimuthal sensing device configured to create a first signal at a first time and a second signal at a second time, the first and second signals indicative of the direction of the drilling tool, the first and second signals affected by at least one of an unknown but substantially constant offset error and an unknown but substantially constant scale factor error; and a drilling direction adjustment element operably connected to and controllable by the controller; wherein the controller is configured to compare the first signal with the second signal and control an adjustment to the drilling direction based on the comparison of the first signal with the second signal.

Embodiment 14

A system in accordance with any embodiment herein, wherein the azimuthal sensing device comprises a magnetometer.

Embodiment 15

A system in accordance with any embodiment herein, wherein the controller performs a preprocessing of the data obtained from the azimuthal sensing device prior to generating the first signal.

Embodiment 16

A system in accordance with any embodiment herein, wherein the preprocessing comprises applying at least one of a filter, a sliding average filter, an infinite impulse filter, a finite impulse response filter, and an observer.

Embodiment 17

A system in accordance with any embodiment herein, wherein the controller continuously obtains and stores information from the azimuthal sensing device.

Embodiment 18

A system in accordance with any embodiment herein, wherein the adjustment of the drilling direction comprises at least one of applying a force using a drilling direction adjustment element against a borehole wall and changing a direction the drilling tool is pointing.

Embodiment 19

A system in accordance with any embodiment herein, wherein the controller is configured to comparing detect a deviation based on at least one of (i) a difference between a peak-to-peak amplitude of the first signal and the second signal, (ii) when the second signal has at least one of a percent difference and an absolute difference from the first signal that exceeds a predetermined threshold percent difference or threshold absolute difference, and (iii) a difference between a mean value of the first signal and the second signal.

Embodiment 20

A system in accordance with any embodiment herein, wherein the controller determines a direction of drilling relative to a compass direction, and wherein the adjustment to the drilling direction is based on the determined direction.

Embodiment 21

A system in accordance with any embodiment herein, wherein the azimuthal sensing device comprises a magnetometer generating a magnetic field signal and an accelerometer generating an acceleration signal, wherein the drilling direction adjustment action is based on a delta time between the magnetic field signal and the acceleration signal.

Embodiment 22

A system in accordance with any embodiment herein, wherein the controller is configured to hold an inclination of the drilling direction substantially constant.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" or "substantially" used in connection with a quantity is inclusive of the stated value and has the meaning dictated by the context (e.g., it includes the degree of error associated with measurement of the particular quantity). For example, the phrase "substantially constant" is inclusive of minor deviations with respect to a fixed value or direction, as will be readily appreciated by those of skill in the art.

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method for controlling a drilling operation, the method comprising:

conveying a drilling tool into a bore and operating the drilling tool to drill in a drilling direction;

creating, with an azimuthal sensing device, a first signal at a first time and a second signal at a second time, wherein each of the first signal and the second signal are indicative of the drilling direction of the drilling tool, and each of the first signal and the second signal are affected by at least one of an unknown but substantially constant offset error or an unknown but substantially constant scale factor error;

comparing the first signal with the second signal; and adjusting the drilling direction based on the comparison of the first signal with the second signal.

2. The method of claim 1, further comprising holding an inclination of the drilling direction substantially constant.

3. The method of claim 1, further comprising preprocessing data obtained from the azimuthal sensing device prior to generating the first signal.

4. The method of claim 3, wherein the preprocessing comprises applying at least one of a filter, a sliding average filter, an infinite impulse filter, a finite impulse response filter, and an observer.

5. The method of claim 1, further comprising continuously obtaining and storing information from the azimuthal sensing device.

6. The method of claim 1, wherein the adjustment to the drilling direction comprises at least one of applying a force using a drilling direction adjustment element against a borehole wall and changing a direction a disintegrating device is pointing.

7. The method of claim 1, wherein comparing the first signal with the second signal includes detecting a deviation based on at least one of (i) a difference between a peak-to-peak amplitude of the first signal and the second signal, (ii) when the second signal has at least one of a percent difference and an absolute difference from the first signal that exceeds a predetermined threshold percent difference or threshold absolute difference, and (iii) a difference between a mean value of the first signal and the second signal.

8. The method of claim 1, wherein the azimuthal sensing device comprises a magnetometer generating a magnetic field signal and an accelerometer generating an acceleration signal, wherein the adjustment to the drilling direction is based on a delta time between the magnetic field signal and the acceleration signal.

9. The method of claim 1, further comprising determining a direction of the drilling direction relative to a compass direction, wherein the adjustment of the drilling direction is based on the determined direction.

10. The method of claim 9, wherein the determined direction of the drilling direction relative to the compass direction is at least one of downlinked from the surface or transmitted from a survey-capable tool inside at least one of a downhole system and a bottomhole assembly.

11. The method of claim 1, wherein a direction of adjustment of the drilling direction is determined automatically by analyzing a response of the second signal to a steering input.

12. The method of claim 1, wherein the adjustment of the drilling direction comprises:

steering in a first direction for a limited amount of time using a drilling direction adjustment element;

monitoring a change of the second signal; and adjusting the first direction in relation to the observed change using the drilling direction adjustment element.

13. A system for controlling a drilling operation, the system comprising:

a downhole system having a drilling tool configured to perform the drilling operation, the drilling operation having a drilling direction;

a controller configured to receive an instruction to activate an azimuthal lock operation during the drilling operation, the controller being part of the downhole system and at least one of a dedicated computing system and a part of an electronic control system;

an azimuthal sensing device configured to communicate with the controller, the azimuthal sensing device configured to generate, during the drilling operation, a first signal at a first time and a second signal at a second time, wherein (i) the first signal and the second signal are indicative of the drilling direction of the drilling tool during the drilling operation and (ii) the first signal and the second signal are affected by at least one of (i) an unknown but substantially constant offset error and (ii) an unknown but substantially constant scale factor error; and a drilling direction adjustment element configured in operable connection to the controller;

wherein the controller is (i) configured to compare the first signal with the second signal and (ii) configured to control an adjustment to the drilling direction by controlling adjustment of the drilling direction adjustment element, based on the comparison of the first signal with the second signal.

14. The system of claim 13, wherein the azimuthal sensing device comprises a magnetometer.

15. The system of claim 13, wherein the controller is configured to preprocess the data obtained from the azimuthal sensing device prior to generation of the first signal.

16. The system of claim 15, wherein the controller is configured to apply, when performing said preprocessing, at least one of a filter, a sliding average filter, an infinite impulse filter, a finite impulse response filter, and an observer.

17. The system of claim 13, wherein the controller is configured to (i) continuously obtain and (ii) store information from the azimuthal sensing device during the drilling operation.

18. The system of claim 13, wherein the adjustment of the drilling direction comprises at least one of applying a force using the drilling direction adjustment element against a borehole wall and changing a direction the drilling tool is pointing.

19. The system of claim 13, wherein the controller is configured to detect a deviation based on at least one of (i) a difference between a peak-to-peak amplitude of the first signal and the second signal, (ii) when the second signal has at least one of (a) a percent difference and (b) an absolute difference from the first signal that exceeds a predetermined threshold percent difference or threshold absolute difference, and (iii) a difference between a mean value of the first signal and the second signal.

20. The system of claim 13, wherein the controller is configured to determine a direction of the drilling direction relative to a compass direction, and wherein the adjustment to the drilling direction is based on the determined direction.

21. The system of claim 13, wherein the azimuthal sensing device comprises a magnetometer configured to generate a magnetic field signal and an accelerometer configured to generate an acceleration signal, wherein the drilling direction adjustment action is based on a delta time between the magnetic field signal and the acceleration signal.

22. The system of claim 13, wherein the controller is configured to hold an inclination of the drilling direction substantially constant.

* * * * *